US010317844B2

(12) United States Patent
Mutrux

(10) Patent No.: US 10,317,844 B2
(45) Date of Patent: Jun. 11, 2019

(54) ANNUAL CALENDAR FOR MECHANICAL WATCHES

(71) Applicant: Bucherer AG, Lucerne (CH)

(72) Inventor: Joachim Mutrux, Ste-Croix (CH)

(73) Assignee: Bucherer AG, Lucerne (CH)

( * ) Notice: Subject to any disclaimer, the term of this patent is extended or adjusted under 35 U.S.C. 154(b) by 0 days.

(21) Appl. No.: 15/564,933

(22) PCT Filed: May 4, 2016

(86) PCT No.: PCT/CH2016/000076
§ 371 (c)(1),
(2) Date: Oct. 7, 2017

(87) PCT Pub. No.: WO2016/179714
PCT Pub. Date: Nov. 17, 2016

(65) Prior Publication Data

US 2018/0095423 A1 Apr. 5, 2018

(30) Foreign Application Priority Data

May 8, 2015 (CH) ..... 638/15

(51) Int. Cl.
*G04B 19/253* (2006.01)

(52) U.S. Cl.
CPC ..... *G04B 19/2536* (2013.01)

(58) Field of Classification Search
CPC ..... G04B 19/25366; G04B 19/2536; G04B 19/25; G04B 19/24393; G04B 19/24366; G04B 19/24; G04B 19/2436; G04B 1/00
See application file for complete search history.

(56) References Cited

U.S. PATENT DOCUMENTS 2,886,910 A 5/1959 Koci
3,716,983 A 2/1973 Tanaka et al.
(Continued)

FOREIGN PATENT DOCUMENTS

CH 697673 B1 1/2009
CH 705 901 A2 6/2013
(Continued)

OTHER PUBLICATIONS

CH705901—Translation—espaccenet.org—Aug. 31, 2018.*
(Continued)

*Primary Examiner* — Sean P Kayes
(74) *Attorney, Agent, or Firm* — Oppedahl Patent Law Firm LLC

(57) ABSTRACT

A date display device with an annual calendar function comprises the following elements: a drive wheel (8) which is coupled to a mechanical movement, a driving device which is driven by the drive wheel (8), a date wheel (4) which periodically interacts with the driving device and is driven by this and a month wheel (5) which is periodically interacts with the date wheel, as well as a month cam disc (6) which is connected to the month wheel. The driving device comprises a driver (8.1) and a rotation axis (8.3), wherein the driver moves on a path about the rotation axis (8.3) of the driving device and the rotation axis adopts at least two different positions relative to the date wheel (4), wherein in a first position, the driving device advances the date wheel by a single unit and in a second position by a plurality of units and wherein the adopted position depends on the number of days of the month concerned.

13 Claims, 6 Drawing Sheets

(56) References Cited

U.S. PATENT DOCUMENTS

Figure 1A:
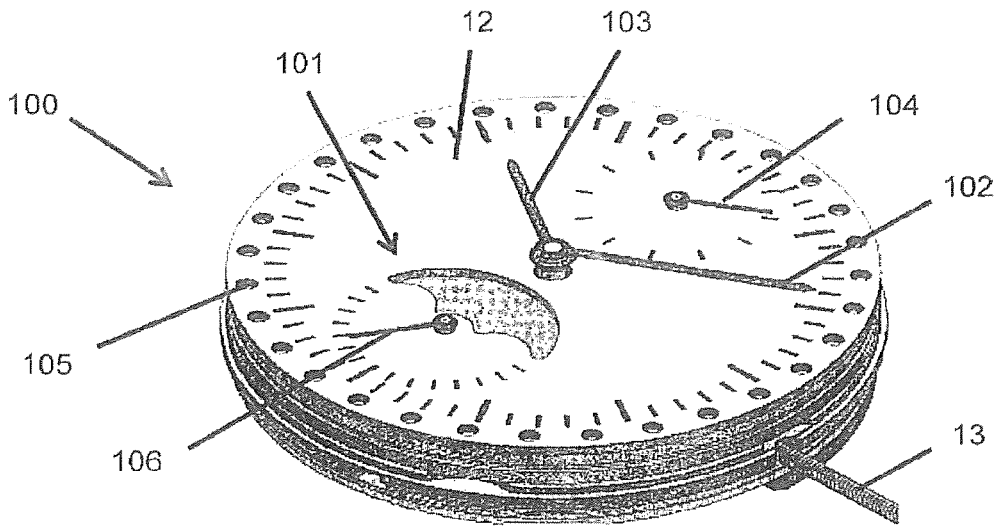

| | | | | |
|---|---|---|---|---|
| 5,379,272 | A | 1/1995 | Parmigiani | |
| 7,218,576 | B1 * | 5/2007 | Bron | G04B 19/25 368/35 |
| 8,842,500 | B2 * | 9/2014 | Schmidt | G04B 19/2536 368/37 |
| 8,861,313 | B2 * | 10/2014 | Suzuki | G04B 19/2538 368/37 |
| 9,164,482 | B2 * | 10/2015 | Villaret | F16H 57/021 |
| 2005/0078558 | A1 | 4/2005 | Dalloz | |
| 2007/0109916 | A1 | 5/2007 | Bron | |
| 2012/0314544 | A1 * | 12/2012 | Suzuki | G04B 19/2538 368/37 |
| 2013/0201801 | A1 * | 8/2013 | Calabrese | G04B 19/25 368/34 |
| 2015/0370221 | A1 * | 12/2015 | Pages | G04B 27/02 368/193 |

FOREIGN PATENT DOCUMENTS

| | | | |
|---|---|---|---|
| EP | 0 191 921 | A2 | 8/1986 |
| EP | 2 479 622 | A1 | 7/2012 |
| JP | S63 313089 | A | 12/1988 |
| JP | 2 651150 | B2 | 9/1997 |

OTHER PUBLICATIONS

Search Report from the Intellectual Property Office of Singapore in application No. 11201708693T, dated Jul. 10, 2018.

Written Opinion from the Intellectual Property Office of Singapore in application No. 11201708693T, dated Jul. 11, 2018.

International Search Report in application No. PCT/CH2016/000076, dated Sep. 2, 2016.

Written Opinion in application No. PCT/CH2016/000076, dated Sep. 2, 2016.

* cited by examiner

ANNUAL CALENDAR FOR MECHANICAL WATCHES

The invention relates to the field of date display devices for mechanical watches and in particular to an annual calendar.

Complications which serve for displaying the date on the dial of a watch driven by a mechanical movement are widespread. Here, amongst other things, one differentiates between simple calendars with date displays without any special provisions for differences in the lengths of the months, annual calendars and perpetual calendars. Regarding annual calendars, the current month is displayed or at least its length (30 or 31 days) is coded and the date switched accordingly by way of the display of the 31st day of a month being automatically jumped in the case of months with only 30 days. Annual calendars require a manual correction once per year (at the end of February), in order to take into account the fact that the month of February only has 28 or 29 days.

Various mechanisms have been suggested and realised, in order to realise an annual calendar on the basis of a time signal originating from the movement. Examples of these can be derived from the documents CH 684 815, EP 1 115 1879, EP 2 479 622 and CH 705 144. Common to all is the fact that when necessary, the date wheel which codes the day of the month undergoes an additional rotation at the end of the 30th day of a month. The approaches, as to how this additional rotation is produced and how it is ensured that this only becomes effectual with months having 30 days, are very different. However, they are all based on an additional mechanism which when necessary intervenes at the end of the month and acts upon the date wheel being integrated into the movement, additionally to the mechanism which drives the date wheel once per day. The complexity, spatial requirement and also energy consumption of the annual calendar are increased to a greater or lesser extent depending on the manner of realisation of this additional mechanism. Moreover, as to whether a simple correction of the date is possible by way of putting forwards or back, which would be advantageous in the case of a longer period of non-use, depends on the specific realisation of this mechanism.

JP 2651150 shows an annual calendar, concerning which a mechanism has the effect of a wheel carrying the date display being advanced by two units only at the end of a short month. A drive wheel which is provided for this and which carries a driver is arranged in a stationary manner.

U.S. Pat. No. 2,886,910 shows a calendar mechanism, concerning which, at the end of the month, a lever via a pin reads out information which is coded by a wheel, as to whether the respective month is long or short. A driver which is fixedly screwed to a gear wheel with a defined rotation axis actuates the calendar mechanism.

CH 705901 shows different annual calendars. In some embodiments, a driver has the effect of a wheel which carries the date display switching directly from the 30th to the 1st day at the end of a short month.

It is the object of the invention to provide a date display device for an annual calendar for a mechanical watch, which in comparison to existing annual calendar complications has a reduced complexity and which provides the possibility of largely making do without additional transmission mechanisms between the mechanical drive and the date wheel.

It is also an object of the invention to provide a date display device which increases the user-friendliness.

These objects are achieved the invention as is defined in the patent claims.

According to an aspect of the invention, the date display device comprises a drive wheel which is coupled onto the movement (clockwork) of the mechanical watch. The device is driven via this coupling and a time signal is herewith also introduced into the device. A device which for its part interacts with a date wheel at regular intervals and drives this is connected to the drive wheel and is driven by this. This device is hereinafter called "driving device". The device moreover comprises a month wheel which, directly or via intermediate wheels, interacts with the date wheel and adopts (assumes) an angular position which represents the month of the year.

The coupling of the drive wheel onto the movement in particular is fixed in the sense that a motion of the movement at all times causes a corresponding movement of the drive wheel—in particular, the drive wheel is connected to the movement via a gear wheel connection.

The angular position of the date wheel—which can be a date gear wheel—is characteristic of the date, and this can be used for the display of the date, either directly or indirectly via an element which is coupled to the date wheel.

The driving device comprises a unit indicated as a "driver" which comes into contact with the date wheel, for example in a direct manner, and further comprises a rotation axis (pivot), about which the driver rotates. Here, the path, on which the driver moves about the rotation axis, is designed for example as a circular path, but this is not a necessity.

In an alternative embodiment, the driver can also indirectly interact with the date wheel, for example via intermediate wheels and/or pins.

The driving device can adopt (assume) at least two positions which differ by their relative position to the date wheel or to the rotation axis of the date wheel, and consequently by the angle, about which the driving device rotates the date wheel per interaction. If, in the first position, the driving device rotates the date wheel by one unit per interaction, then in a second position it rotates the date wheel by a plurality of units per interaction. Given a predefined angular position of the date wheel (corresponding to the month end, in particular to the 30th of the month), the device is configured to bring the driving device from the first into the second position or not, depending on a condition of the month wheel.

The fact that the driving device can adopt (assume) two positions relative to the date wheel means that the driving device as a whole can adopt (assume) two positions relative to the date wheel, i.e. in particular also the rotation axis of the driving device—i.e. in particular the two positions do not merely differ by different rotation positions of the driving device.

A month cam disc which codes the length of the month and which permits a movement into the second position or not depending on its angular position can be coupled onto the month wheel—and under certain circumstances can also be as one piece with this.

Date display devices of the presently claimed type are often seen as examples for so-called complications or intricacies. This however should not represent any detail concerning the complexity of the device. Indeed, in contrast, the approach according to the invention permits a particularly simple construction which, if necessary, can be particularly well integrated into the movement (clockwork).

According to the aspect of the invention, it is therefore possible and indeed envisaged for one and the same mechanism to be used for advancing the date wheel by one day at a regular date change as well as for the advance of the date wheel by more than one day at the end of a shorter month. The difference between the advancing by one or more days is therefore not accomplished by way of different mechanisms as is known from the state of the art and also not by way of differently far drive paths (for example differently large rotations) of the driving mechanism, but by way of the adjustment of a relative position of the driving mechanism (driving device) and of the date wheel. This permits a design which is significantly simplified compared to the state of the art, with only a few additional elements being necessary for the annual calendar function and almost with additional spatial requirement.

The relative movement between the first and the second position for example is a movement of the driving device relative to the other parts of the device, and the date wheel is then therefore fixed with regard to its position. However, a converse design (movement of the date wheel for example given a fixed path of the driving device) is also not ruled out.

The first of the two positions corresponds to the normal position which is constantly assumed with the exception of the end of the month. The second position is assumed in short months at the end of the month, so that the date wheel in its motion jumps one day on interaction with the driving device.

The positions of the driving device and the date wheel can thereby differ in their horizontal positions, i.e. in a plane parallel to the plane of the date wheel, as well as vertical positions. In particular, in the second position, the rotation axis of the driving device can be closer to the rotation axis of the date wheel than in the first position.

The different relative positions could also be realised differently, instead of by way of a different position parallel to the date wheel plane, for example by way of different positions perpendicular to the plane. In these embodiments, the date wheel comprises means, in order to interact with the driver in a position-dependent way and manner in every position of the driving device.

A change of the angle, about which the date wheel rotates per interaction with the driving device, can be realised for example by way of the overlap between the path, on which the teeth of the date wheel move and the path of the driver increasing accordingly. Concerning such an embodiment, the rotation of the date wheel is realised for example by way of the driver meshing with the teeth of the date wheel and catching this before the driver and the date wheel decouple again due to their different paths. If, in the second position, the rotation axis of the driver is closer to the rotation axis of the date device, the driver then engages earlier and is engaged with the date wheel over a longer stretch than in the first position. The driver can be mounted in a radially resilient manner, in order to compensate the unequal distances.

In embodiments, the driver is designed as a driver head or driver pin. This can move on a circular path about its rotation axis.

The driver and the rotation pivot (axis), as mentioned, are preferably connected such that the driver is resiliently mounted radially to its path. This connection is moreover designed for example such that the driver is rigidly connected to the drive wheel tangentially to the path in a direct or indirect manner. This can be realised for example by way of the driver being held on a resilient arm which runs roughly in the peripheral direction. In an embodiment, the connection between the driver and its rotation pivot can be designed spirally.

The driving device can moreover optionally comprise stops which fix a maximal radial and/or tangential deflection of the driver. These can be designed such that they define different positions which the driver can assume. Alternatively or supplementarily, these can also serve for protection against too large a mechanical action which could result in damage to the driving device.

In an embodiment, the rotation axis of the driving device is identical to that of the drive wheel which drives the driving device. In this case—and very generally as an option—the axis of the drive wheel for example is not fixed but is movable between different positions—in particular in accordance with the positions of the driving device.

Moreover, the driving device can be designed such that the driver interacts once with the date wheel per complete revolution (rotation) of the drive wheel. For this, the driving device can be fixedly (firmly) connected to the drive wheel, for example by way of the rotation axes or pivots of the drive wheel and the driving device being coupled in a rotationally fixed manner. The driver can also come into contact with the date wheel in a direct manner, i.e. without intermediately connected elements.

In embodiments, the shape of the teeth of the date wheel and the shape of the driver are matched to one another such that these mesh into one another in an exactly fitting manner. Moreover, these can be designed such that occurring small angular position errors are automatically corrected. The error tolerance is increased further by a radially resilient, tangentially rigid mounting of the driver.

An embodiment for realising at least two different positions of the driving device relative to the date wheel additionally comprises a coupling lever, on which the rotation axis of the driving device is seated. Here, the rotation axis of the driving device does not correspond to that of the coupling lever. The at least two positions of the driving device are hereby given by at least two conditions of the coupling lever which differ in the alignment of the coupling lever.

The coupling lever can moreover comprise a spring leaf as well as one or more coupling portions, for example each in the form of a coupling pin, of a roller, of a stop surface, etc. The spring leaf thereby presses the coupling portion(s) in a defined direction against one or more components of the device or of the watch. By way of this, it is possible for the condition of the coupling lever to be dependent on the position, alignment and/or condition of other components.

In an exemplary embodiment with a coupling lever, the date wheel or a separate element which is coupled to this can comprise a (running) track (runway) which for example is incorporated above or below the toothing and which comprises a recess at that angular position of the date wheel which identifies the 30th day of the month. If the one coupling portion—for example a coupling portion which formed as a roller—is pressed into the recess, then the coupling lever changes into the second position.

In embodiments, the spring leaf moreover presses a second coupling portion which is present on the coupling lever—for example a pin—against the month cam disc and simultaneously the first coupling portion against the running track. By way of this, the first coupling portion (for example roller) runs on the runner track and the second coupling portion (for example pin) reads out the length (28-30 or 31 days) of the month. Consequently, it is possible for the coupling lever to switch into a second condition, in which the driving device is at the second position, should the first coupling portion identify the 30th day of the month and the second coupling portion simultaneously identify a month with only 30 days. This can be effected such that the second coupling portion does not lie on the month cam disc in a month with 30 or less days and, by way of this, not preventing the second coupling portion from running into the recess of the running track.

A month cam disc of the mentioned type can be arranged above or below the month wheel, wherein the rotation axis (pivot) of the month cam disc is identical to that of the month wheel and is connected to this in a rotationally fixed manner. The month cam disc and the month wheel can also be manufactured from one piece.

Yet further positions of the driving device can be defined with the help of such a coupling lever and additional positioning elements.

In embodiments, the rotation axis of a gear wheel, said gear wheel on the one hand interacting with the movement and on the other hand with the drive wheel, coincides with the rotation axis of the coupling lever. Herewith, it is ensured that this gear wheel remains connected to the drive wheel as well as to the movement, independently of the position which is assumed by the coupling lever or by the driving device.

In embodiments, there are 31 defined angular positions for the date wheel and these positions are defined by 31 equidistant teeth. In these embodiments, in a first position relative to date wheel, the driving device rotates the date wheel by one tooth per day and interaction. If the driving device is situated in a second position relative to the date wheel, then an advance by two teeth is effected given an interaction. In particular, in the second position, the driving device will be closer to the date wheel and the driver will engage on a tooth which lies further to the front with regard to the rotation direction.

In an alternative embodiment, the date wheel can also comprise n*31 teeth, wherein n is an integer. If the driver rotates about its own axis once per day and thereby interacts once with the date wheel, then in the first position, the driving device rotates the date wheel by 360/(31*n) degrees and by 2*360/(31*n) degrees when the driving device is located in a second position.

Embodiments, in which the driving device rotates about its own axis several times per day or in which the driving device comprises at least two drivers are further conceivable. In such embodiments, that which has been specified above, in particular the doubling of the angle, about which the date wheel rotates per interaction, is implemented accordingly.

In embodiments, the date wheel interacts directly with the month wheel, i.e. without intermediately arranged gear wheels. For this, the month wheel and the date wheel comprise means which permits a rotation of the month wheel which is initiated by the date wheel. For example, the date wheel can comprise a month wheel driving pin which is arranged such that this on its own or in combination with other month wheel driving pins, after the completion of a month, has rotated the month wheel to the angular position which is characteristic of the beginning month. For this, the month wheel driving pins in particular can engage directly into the toothing of the month wheel.

In embodiments, the month wheel can assume 12 defined angular positions which are defined for example by way of 12 equidistant teeth. If moreover the date wheel rotates about its own axis once per month, then an interaction between the date wheel and the month wheel on the last day of each the month is sufficient, in order for the month wheel to assume the angular position which is correct for the beginning month.

In further embodiments, the device comprises means which permit a visual reading of preferably the complete date, consisting of the current day of the month, the day of the week and the current month, but at least the actual day of the month, by the user and via the dial of the watch.

In embodiments, in which the date wheel can assume 31 and the month wheel 12 defined angular positions, this can be effected by way of means for visualisation which are coupled directly onto the respective gear wheel. A corresponding day wheel which can assume seven defined angular positions and interacts with the drive wheel or date wheel once per day can be realised in a manner which is known per se.

As is known per se for complications, the device can comprise lever springs which latch with different gear wheels, in particular with the date wheel and/or the month wheel when these assume a predefined angular position. The precision of the angular position which is assumed by the various gear wheels can be increased in this manner, and a simultaneous arresting of these can simultaneously be ensured. The latter increases the reliability of the watch with regard to external influences or disturbances, for example due to impacts.

In a group of embodiments of the invention, the device comprises a device, with which the date can be put forward or back by the user in a simple manner. In particular, this is realised by way of the rotation axis of the driving device being able to assume a further, hereinafter called "third" position relative to the date wheel, in which position the driving device does not interact with the date wheel. The switching to this third position is initiated by the user by way of actuating (for example pulling out) a crown which is attached at the outside to the casing of the watch. As soon as the driving device is in this third position, the date can be set via the crown which is attached to the casing, by way of rotating the crown for example. Here, the date can be put forward or back.

Embodiments of this group can be based on the coupling lever which is described above, on the crown which is attached to the housing at the outside and on a gear wheel, said gear wheel being coupled to the crown and beginning to interact directly or indirectly with the date wheel as soon as the switching to the third position of the driving device has been initiated via the crown. Here, the coupling between this gear wheel and the crown is designed such that the date can be set in a simple manner, e.g. by way of rotating the crown.

In embodiments, the coupling lever comprises at least one decoupling portion, for example in the form of a decoupling pin. This serves for transposing the relative position of the crown with respect to the casing of the watch into an alignment of the coupling lever. For example, a pulling-out of the crown is converted via the decoupling portion such that the rotation axis of the driving device assumes the third position. In this third position, the path of the driver does not overlap with that of the teeth of the date wheel. The date wheel, the month wheel and all further elements of the device which lead to a visualised date detail on the dial are consequently decoupled from the drive wheel and hence from the movement itself.

In embodiments of this group, the device can moreover comprise a decoupling lever with at least two defined conditions. The decoupling lever for its part can comprise a spring leaf, a rotation pivot as well as elements, with which different conditions of the decoupling lever can be defined and which permit a switching between the different conditions. The decoupling lever thereby interacts directly or indirectly with the crown and with the coupling lever, or the decoupling portion, and ensures that a change of the relative positions of the crown which is attached outside the casing leads to a corresponding change of the alignment of the coupling lever and therefore of the position of the rotation axis of the driving device.

For example, the gear wheel which can be brought into participation and which then interacts with the crown and the date wheel can be arranged on such a decoupling lever, but not on its rotation axis.

The driving device yet being able to assume further positions, apart from the discussed first, second and possible third position is also not ruled out.

The just described embodiment for the positioning of the driving device in actuality is a mechanical implementation of the principle of the classic AND-logic. This is the case because each tracer enquires information relevant to the date and permits a switching of the lever via the rigid connection of the tracer to the coupling lever, in the case that the enquired date condition occurs. However, the lever only switches into another position when all enquiries of the date condition which are of relevance to this position provide a corresponding result. Extensions of the annual calendar, for example towards a perpetual calendar, are conceivable on the basis of this.

Apart from the date display device which, as mentioned, can be considered as a complication, a mechanical watch also belongs to the subject-matter of the invention. Such a watch, apart from the date display device, also comprises a movement and a time display with at least two hands and a dial, which can all be designed in the manner known per se.

Figure 1B:
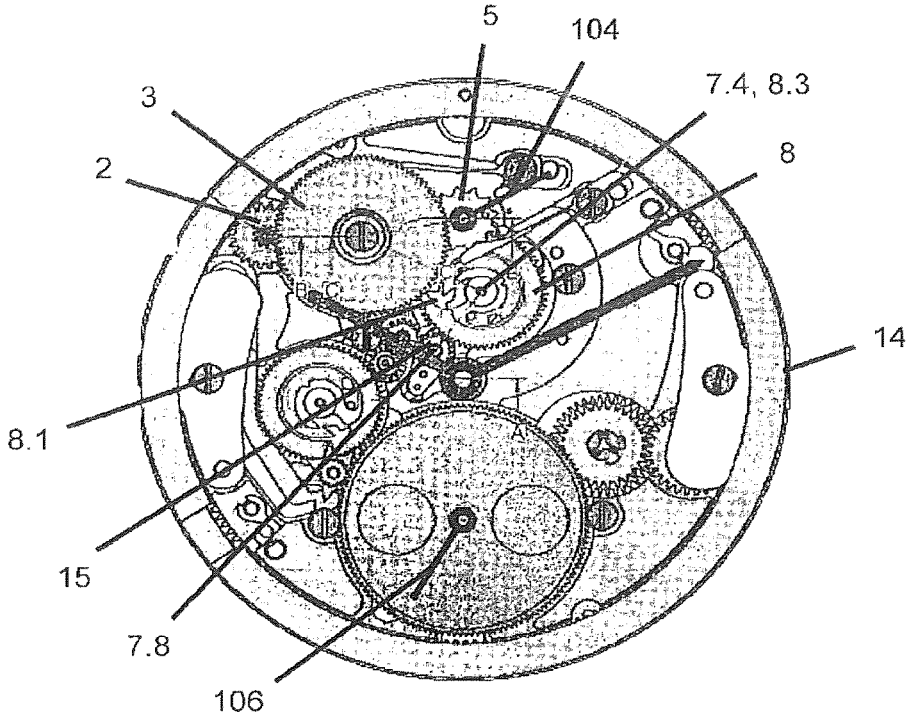
Figure 2:
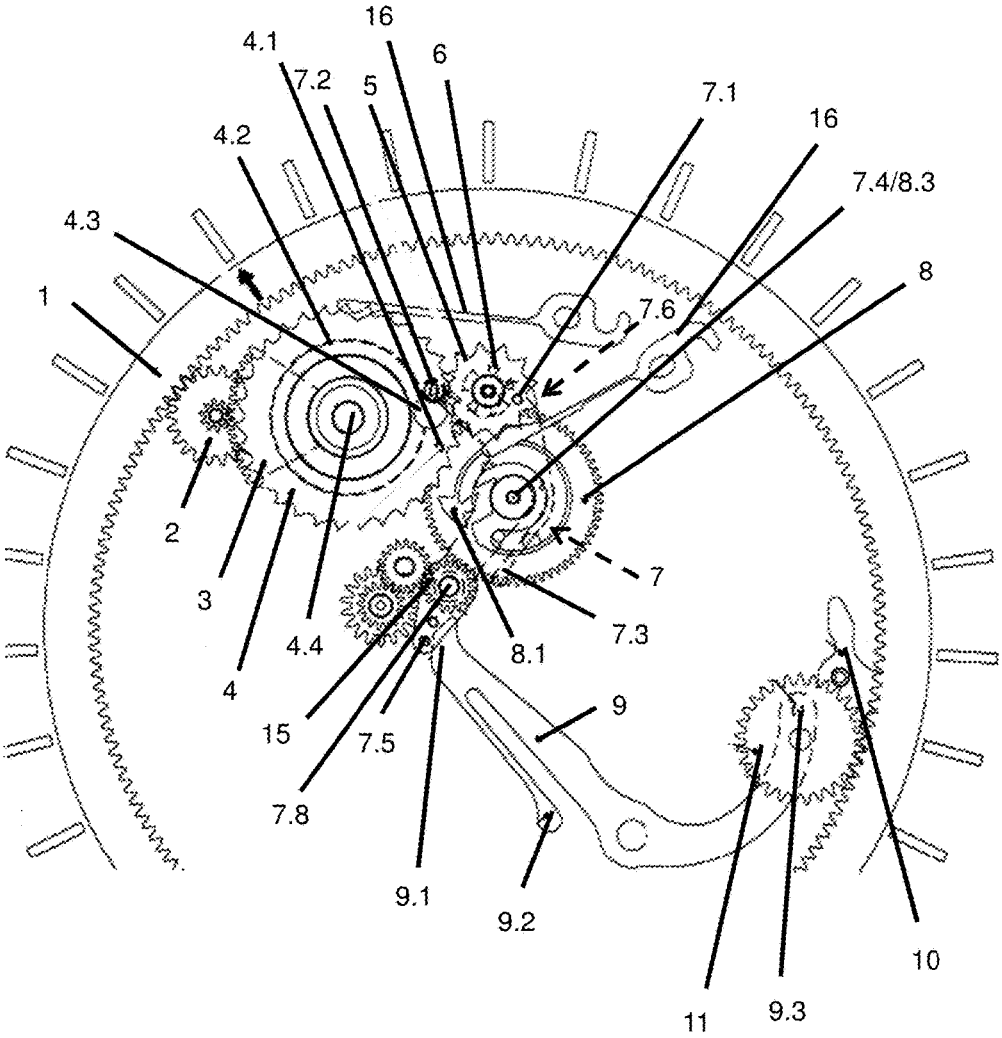
Figure 3B:
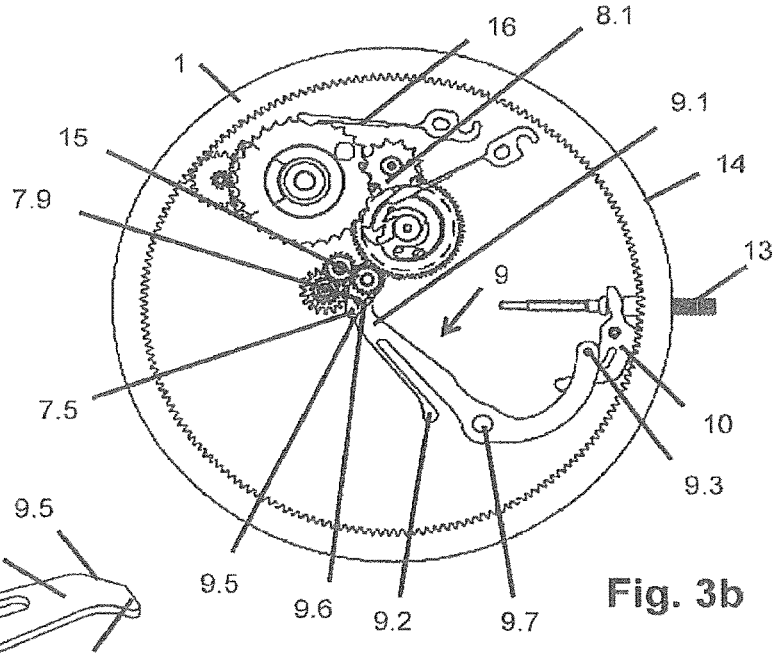
Figure 3A:
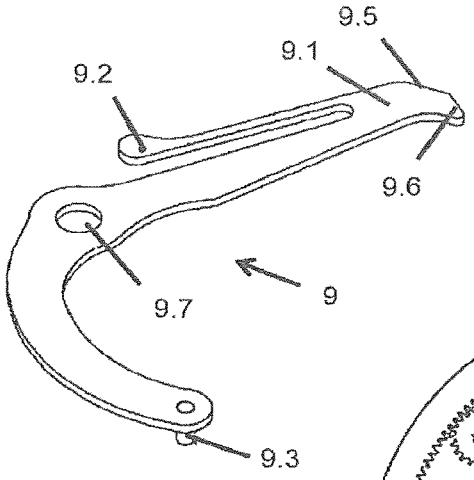
Figure 3C:
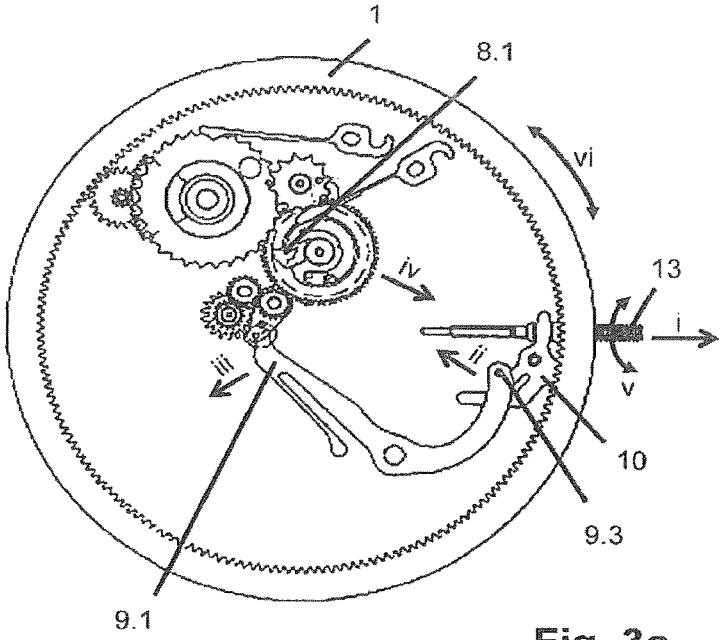
Figure 5:
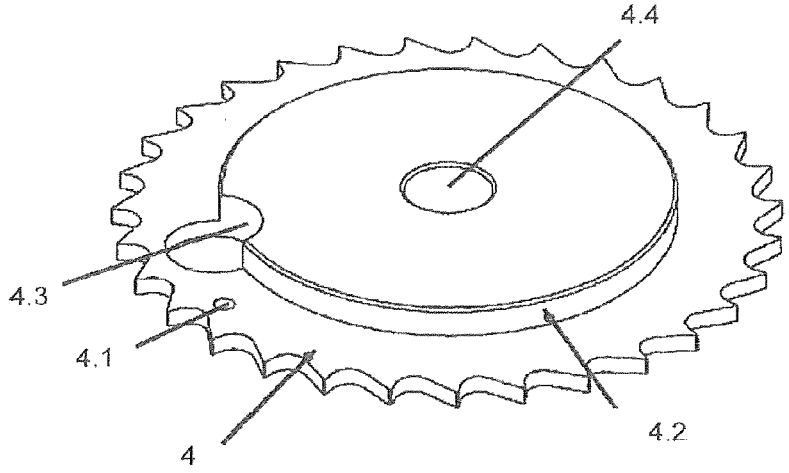
Figure 6:
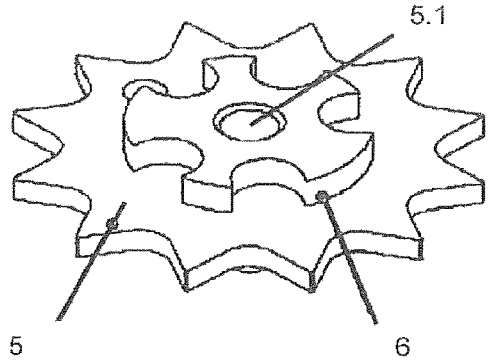
Figure 7:
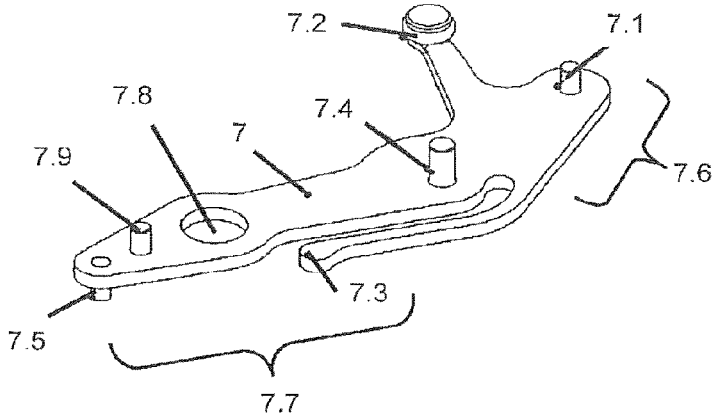

The subsequent drawings represent exemplary embodiments of the invention, by way of which the invention is described in detail. In the drawings, the same reference numerals refer to the same or analogous elements. The drawings show in:

FIG. 1*a*-1*b* in each case, an outer and an inner view of a watch which comprises an annual calendar of the type according to the invention;

FIG. 2 the construction of an embodiment of the annual calendar;

FIGS. 3*a*-3*c* an embodiment for the correction of the date by the user;

FIGS. 4*a*-4*f* an embodiment of an automatic consideration of months with 30 and 31 days;

FIG. 5 an exemplary embodiment of the date wheel;

FIG. 6 an exemplary embodiment of the month wheel and the month cam disc; and FIG. 7 an exemplary embodiment of a coupling lever.

The manner of functioning and the implementation of the invention are hereinafter shown by way of different, exemplary embodiment examples. It is to be understood that the invention is not limited to these embodiments, but also includes other embodiment examples which are in conformity with the claims.

FIGS. 1*a* and 1*b* show an outer view (FIG. 1*a*) and an inner view (FIG. 1*b*) of a mechanical watch 100 with an annual calendar, with regard to which, apart from the time, the day of the month and the month itself are displayed. Such a watch comprises the following elements: a dial 12, on which devices (for example indices) are attached, said devices in combination with hands or other visualisation methods permitting the reading of the time, the day of the month and the month. Moreover, a minute hand 102, an hour hand 103 and a month hand 104 as well as date display 105 which in the shown embodiment is incorporated radially outwards on the watch dial can also be seen. Moreover, the shown watch comprises a setting (adjusting) device 13 as well as a complication (intricacy) for the display of the phase of the moon (moon phase watch 101) with an associated hand 106, whereby such a complication is not essential to the invention. The setting device at its end which is situated outside the watch can be terminated by a crown (not shown), wherein the crown for example is fixedly (firmly) connected to the setting device.

Amongst other things, the mechanics of the annual calendar comprise the following elements which can be easily recognised in FIG. 1*b*: intermediate wheel 2, transfer date gear wheel, month wheel 5, rotation pivot (axis) 7.4 of the drive wheel 8 which in the shown embodiment is identical to the rotation pivot (axis) 8.3 of the driver 8.1, a gear wheel 15 for coupling the annual calendar to the mechanical watch a well as its rotation pivot 7.8. The hands for reading off minutes 102, hours 103, month 104 and the moon phase 106 are also included in the inner view for a better orientation. The watch itself is closed by a casing 14.

The functions of these and further elements of an annual calendar which is based on the invention and their interaction are described by way of the subsequent figures.

FIG. 2 shows the components which are necessary for realising the annual calendar as well as their interaction. The annual calendar is driven by way of the drive wheel 8 which is connected to the movement via a gear wheel 15. The rotation pivot 7.4 of the drive wheel is mounted on a coupling lever 7 and is designed such that per day, the drive wheel rotates once in a complete manner, i.e. by 360°, about the rotation axis which is given by the position of the coupling lever.

A driving device which comprises a driver which is designed as a driver head 8.1 and further comprises a rotation pivot (axis) 8.3 is connected to the drive wheel. The rotation axis 8.3 of the driver head 8.1 coincides with the rotation axis 7.4 of the drive wheel 8, wherein these two rotation axes are connected to one another in a rotationally fixed manner. The driver head 8.1 likewise rotates about its axis 8.3 once per day in a complete manner by way of this.

The driver head 8.1 is designed such that it interacts with a date wheel 4 once per day. The date wheel 4 is designed as a gear wheel with 31 teeth which are equidistantly arranged on a given radius. The date wheel moreover comprises a running track 4.2 and a month wheel driving pin 4.1. FIG. 5 shows a detailed view of an exposed date wheel 4. Apart from the mentioned elements, one can recognise a fixation opening 4.4 whose centre coincides with the rotation axis of the date wheel. The running track 4.2 is designed as a circular disc which at a location and radially to the outside comprises a semicircular recess 4.3.

The date wheel 4 for its part is actively connected to a month wheel 5 via the month wheel driving pin 4.1. The month wheel 5 comprises twelve teeth which are arranged equidistantly on a given radius. A month cam disc 6 is fixedly connected to the month wheel. FIG. 6 shows a detailed view of an exposed month wheel with a month cam disc. The month wheel driving pin 4.1 is arranged on the date wheel 4 such that this meshes with a tooth of the month wheel once per complete revolution (rotation) of the date wheel 4 and catches this further by one position due to its further advance on its circular path. By way of this, it is ensured that the month wheel has rotated about its axis once in a complete manner, i.e. by 360°, after twelve complete revolutions of the date wheel. The reference numeral 5.1 indicates a fixation opening which passes centrally through the month cam disc and whose centre coincides with the rotation axes of the month wheel and the month cam disc.

Lever springs 16 ensure that the gear wheels only assume well-defined angular positions and that they remain in these angular positions until the next interaction with another element of the device or of the watch takes place. The lever springs also prevent external influences from leading to faulty functions.

The coupling lever 7 and thus the rotation axes 7.4/8.3 of the drive wheel 8 and the driver head 8.1 respectively can assume two positions, in order to ensure a correct differentiation between months with 30 and 31 days and thus to avoid an incorrect date display as well as the necessity of resetting the date by hand (except for at the end of February). The coupling lever 7 is designed in a Y-shaped manner, wherein the three ends of the coupling lever which are given by the Y-shape comprise elements for interaction with further components of the annual calendar.

For an improved visualisation, FIG. 7 shows a detailed view of an exposed coupling lever. The head-side end 7.6 of the coupling lever comprises a roller 7.2 as well as a coupling pin 7.1. The coupling pin 7.1 traces the month cam disc 6 which is divided into twelve segments. These segments are arranged such that they are in an unambiguous relation to the positions of the month which are given by the teeth of the month wheel 5, by way of the month cam disc 6 being connected to the month wheel 5 in a rotationally fixed manner. The segments moreover vary in their radii, by way of them having one of two possible radii. The larger of the two radii thereby codes a month with 31 days, whilst the smaller of the two radii represents a month with 30 days.

The coupling lever 7 is pressed in the direction of the date wheel 4 by way of a spring force which is produced by a leaf spring 7.3, so that the roller 7.2 rolls on the running track 4.1. The roller 7.2 reaches a recess 4.3 at the end of each month, by which means the running track cannot prevent a movement of the coupling lever towards the date wheel.

If the coupling pin 7.1 now lies in the region of a segment having the larger of the two radii, then a butting of the coupling pin 7.1 on the respective segment of the month cam disc prevents the roller from being pressed into the recess 4.3. The coupling lever and thus the rotation axes 7.4/8.3 of the drive wheel and driver head respectively therefore remain at the first position, which leads to the driver head 8.1 continuing to catch the date wheel 4 by exactly one position per complete orbit, just as if the roller 7.2 were not to be located at the recess 4.3 of the running track 4.2.

However, if the coupling pin 7.1 lies in the region of a segment which has the smaller of the two radii, then as soon as the roller comes into the region of the recess 4.3 of the running track 4.2, the coupling pin cannot prevent a positional change of the coupling lever 7. The coupling lever rotates about its rotation axis 7.8 on account of this, and the rotation axes 7.4/8.3 of the drive wheel and of the driver head respectively displace in the direction of the date wheel 4. The latter leads to the enlargement of the overlap of the path, on which the driver heads moves and the path, on which the 31 teeth of the date wheel are arranged.

A fixation opening 7.8 and a further coupling pin 7.9 are moreover represented in FIG. 7. The axis of the fixation opening coincides with the rotation axis of the coupling lever and with that of the gear wheel 15 which e.g. is shown in FIG. 2 and which accomplishes the coupling of the annual calendar to the movement. By way of this design, it is ensured that the gear wheel 15 on the one hand has an interaction with the movement itself and on the other hand with the drive wheel, said interaction being independent of the assumed position of the coupling lever 7.

The interaction between the driver head 8.1 and the date wheel 4 in particular is effected by way of the circle, on which the drive head moves and the circle, on which the 31 teeth of the date wheel are arranged, partially overlapping so that the driver head meshes with a tooth of the date wheel and catches this with its further advance on its circular path. If, in the second position of the driving device, the overlap of the paths is larger, then the stretch, over which the date wheel is caught, increases accordingly: the date wheel is adjusted by two units.

Due to this mechanism, the recess 4.3 and the roller 7.2 are designed such that the driver head catches the date wheel by two units at the end of the 30th day of a month, said month being identified as a month with 30 days via the month cam disc 6. After this one day, the roller leaves the recess 4.3 again, by which means the driver head again assumes the position which is retracted with respect to the date wheel. By way of this, given its subsequent interaction with the date wheel, the driver head catches this date wheel again by only one position.

The driver head is mounted in a radially resilient manner, in order to compensate the different distances to the date wheel in the first and second position. In the represented embodiment, this is realised by way of the connection between the driver head 8.1 and the rotation pivot 8.4 of the driver head being designed in an elastically deformable manner. This permits the driver head to temporarily displace its position in the direction of its rotation axis, should an accordingly directed force be exerted upon the driver head by the date wheel.

The driver head can moreover be designed such that an alignment of the driver head which is changed relative to the teeth of the date wheel and which is caused by the position of its rotation axis cannot lead to a jamming.

A further advantage of a radially resilient mounting of the driver head is the fact that the driver head is pressed in between the teeth of the date wheel due to a suitable design of the resilient mounting. Relative position errors between the date wheel and the driving device, with regard to the relative position of their rotation axes as well as to the angular positions of the date wheel and the driver head can be corrected by way of this.

The mechanism which has just been described and which forms the basis of the device is drawn step for step in the FIGS. 4*a*-4*f* As already mentioned, the length of the month is coded by way of a segmenting of the cam disc 6. In the represented embodiment, a segment with the greater radius represents a month with 31 days and a segment with the smaller radius represents a month with 30 days. If the larger radius is specified by H and the smaller radius by L, the month cam disc comprises the following radii sequence for the months of January to December: HLHLHLHHLHLH.

Figure 4A:
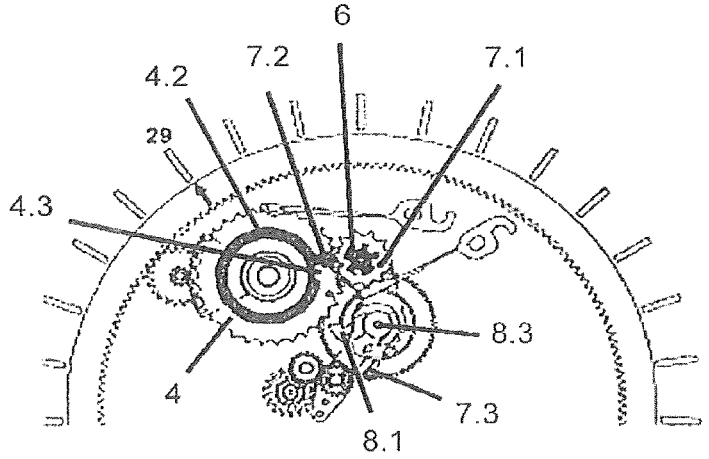

FIG. 4*a* shows the initial position on the 29th day of a month having 30 days. The roller 7.2 is still located before the recess 4.3, by which means a switching of the coupling lever is prevented, although the coupling pin 7.1 would not prevent such a switching. By way of this, the rotation axis 8.3 of the driver head 8.1 remains in the position which is retracted with respect to the date wheel 4, and the driver head catches the date wheel by only one position in the upcoming interaction.

Figure 4B:
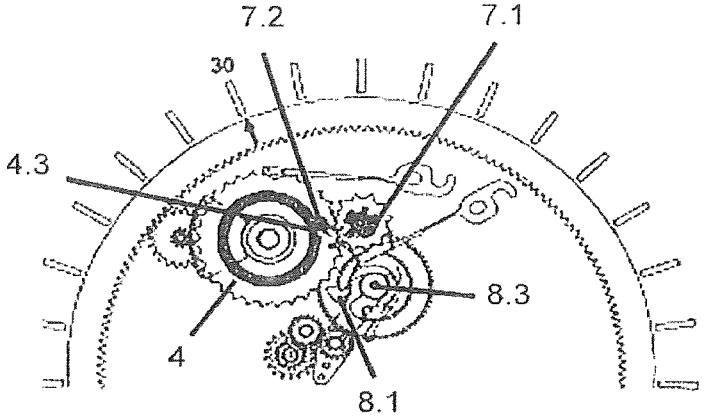

FIG. 4*b* shows the situation on the 30th day of a month having 30 days. Since the coupling pin 7.1 is located over a segment of the cam disc 6 which has a smaller radius, a running of the roller 7.2 into the recess 4.3 is not prevented. The coupling lever consequently rotates, and the rotation axis 8.3 of the driving device changes into the position which is closer to the date wheel. This leads to the driver head catching the date wheel by two positions in the upcoming interaction.

Figure 4C:
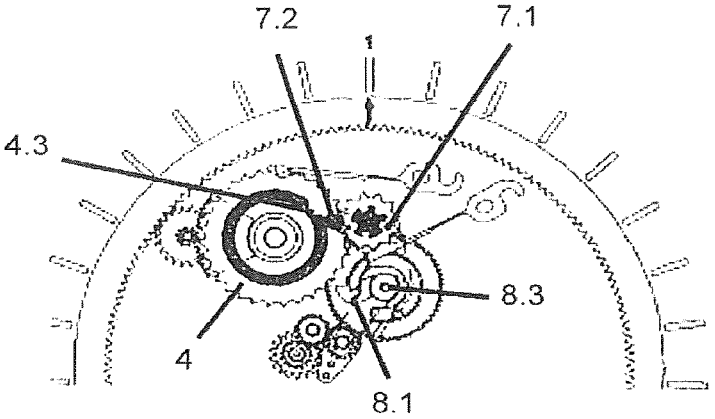

FIG. 4*c* shows the situation on the first day of the subsequent month. The roller 7.2 has left the recess 4.3 again. The coupling lever has consequently rotated back into its initial position, by which means the rotation axis 8.3 of the driving device again assumes the position which is retracted with respect to the date wheel.

Figure 4D:
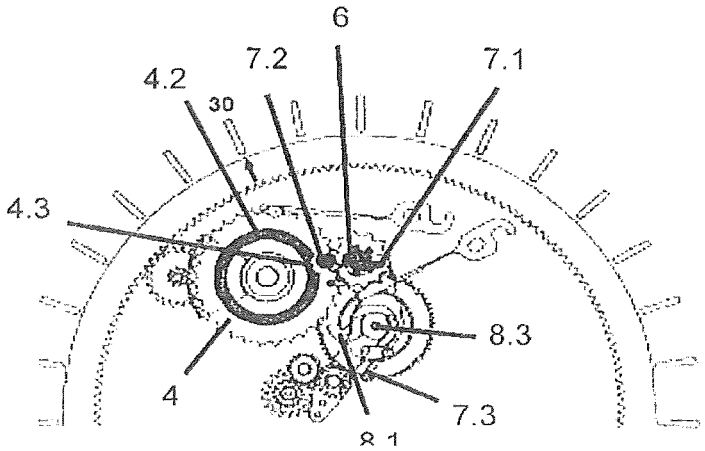

FIG. 4*d* shows the situation on the 30th day of a month with 31 days. Since it is a month with 31 days, the coupling pin 7.1 is located over a segment of the cam disc 6 which has a larger radius. A switching of the coupling lever and therewith of the rotation axis of the driving device is prevented by way of the coupling pin lying on the segment.

Figure 4E:
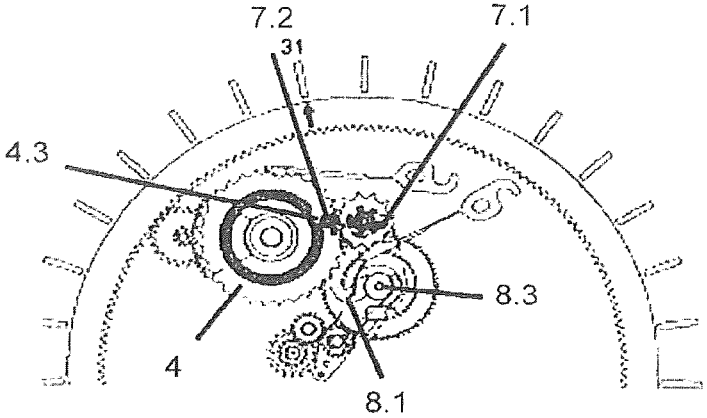
Figure 4F:
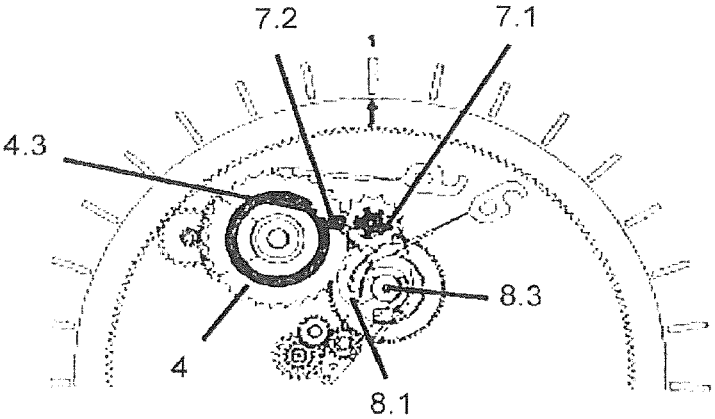

FIG. 4*e* shows the situation on the 31st day of a month having 31 days. The coupling pin 7.1 as well as the roller 7.2 now prevent a switching of the coupling lever, by which means the rotation pivot or axis 8.4 of the driver device remains in the position which is retracted with respect to the date wheel 4. On this day, the driving head 8.1 therefore catches the date wheel 4 by only one position, to the next day of the subsequent month.

The watch comprises a mechanism which permits a decoupling of the date display and its drive by the movement, for setting the date for the first time which is to say for resetting the date, e.g. after the watch not having been used for a long time, as well as for setting the date at the end of February, by the user. The elements which in an exemplary embodiment effect the transfer of the control over the date display from the drive wheel 8 to the setting gear wheel 11 are likewise represented in FIG. 2. This mechanism is now explained by way of the detailed views which are shown in FIGS. 3*a*-3*c*.

In the shown embodiment, the mechanism is based on a decoupling lever 9 (FIG. 3*a*) which at the end 9.1 which is situated towards the coupling lever 7 comprises two surfaces which are angled to one another. One of these two surfaces in accordance with its function is hereinafter called the coupling surface 9.5 and the other is called a decoupling surface 9.6. The decoupling lever moreover comprises a coupling pin 9.3 which is situated towards a setting device 13, laterally a spring leaf 9.2 and a fixation opening 9.7, wherein the centre of the fixation opening coincides with the rotation axis of the decoupling lever. The mechanism finally comprises a deflecting element 10.

FIG. 3*b* shows the situation, in which the date detail is controlled by the mechanical annual calendar. The setting device 13 here is in its basic position, in which it is recessed maximally into the casing. In this position, the deflecting element 10 and the decoupling lever 9 assume an alignment which leads to a decoupling pin 7.5 which is attached on the lower side of a foot part 7.7 of the coupling lever 7 lying on the coupling surface 9.5 (see also FIGS. 7 and 3.*c*).

FIG. 3*c* shows the mechanism which leads to the control over the date display changing from the movement to the setting device 13. The arrows which are drawn in FIG. 3*c* here indicate directions of movements, said movements being able to be carried out by the respective elements during the steps i to vi. The pulling of the setting device 13 (step i) out of the casing 14 in the radial direction up to a stop or latching point (not shown) leads to the deflecting element 10 pressing the coupling pin 9.3 in the direction of the centre of the watch (step ii), and the end 9.1 of the decoupling lever which is situated towards the coupling lever rotating radially outwards (step iii). The decoupling pin 7.5 changes from the coupling surface 9.5 onto the decoupling surface 9.3 by way of this, which leads to the rotation axis 8.3 of the driver head 8.1 which is located on the coupling lever 7 distancing itself so far from the date wheel (step iv), that the path, on which the driver head moves and the circle, on which the 31 teeth of the date wheel are arranged no longer overlapping. The date display is consequently decoupled from the drive wheel and therefore from the movement. The setting gear wheel 11 which is shown in FIG. 2 comes into contact with the display toothed ring 1 and with the thread of the setting device 13, simultaneously with the decoupling of the date display and the drive wheel. By way of this, it is possible to rotate the date forwards as well as backwards (step vi) by way of rotating the setting device (step v).

The invention claimed is:

1. A date display device for a watch, wherein the device is equipped for realizing an annual calendar function and comprises the following elements:

a drive wheel coupled to a mechanical movement;

a driving device driven by the drive wheel;

a date wheel periodically interacting with the driving device and being driven by said driving device, wherein an angular position of the date wheel is characteristic of the date; and a month wheel is periodically driven in a manner depending on a condition of the date wheel, wherein the driving device comprises a driver moving on a path about a driver rotation axis the driving device being configured to adopt at least two different positions relative to the date wheel, wherein given the periodic interaction with the date wheel, the driving device in a first position advances the date wheel by a single unit and in a second position by a plurality of units and wherein the device is configured, given a predefined angular position of the date wheel, to bring the driving device from the first into the second position or not depending on a condition of the month wheel, wherein the position of the driver rotation axis differs between the first and the second position, the device further comprising a coupling lever, on which the driver rotation axis is seated, wherein the coupling lever comprises a coupling lever rotation axis which does not coincide with the driver rotation axis, and wherein a movement between the first and the second position entails a rocking movement of the coupling lever about the coupling lever rotation axis.

2. The device according to claim 1, wherein the driver is designed as a driver head.

3. The device according to claim 1, wherein the driver is resiliently connected to the rotation axis the driver being resiliently displaceable in a direction that is radial with respect to the driver rotation axis.

4. The device according to claim 1, wherein the driver rotation axis is identical to the rotation axis of the drive wheel and is fixedly connected to this.

5. The device according to claim 1, wherein in the first of the at least two positions of the driving device, the driver per complete revolution about its rotation axis rotates the date wheel by about 360/(31*n) degrees and in the second of the at least two positions of the driving device, the driver per complete revolution about its rotation axis rotates the date wheel by about 2*360/(31*n) degrees, wherein n is an integer.

6. The device according to claim 5, wherein the date wheel is designed as a date gear wheel with 31*n teeth.

7. The device according to claim 1, wherein the driving device via the driver interacts with the date wheel in a direct manner, without using an intermediate wheel.

8. The device according to claim 1, wherein the coupling between the movement and the drive wheel is effected via a gear wheel, whose rotation axis is seated on the rotation axis of the coupling lever.

9. The device according to claim 1, wherein the coupling lever comprises a first coupling portion in the form of a roller which moves on a running track fixedly connected to the date wheel and having a recess, wherein a movement of the roller into the recess corresponds to a transition from the first into the second position.

10. The device according to claim 1, comprising a month cam disk coupled onto the month wheel or being formed by the month wheel, wherein the coupling lever comprises a second coupling portion interacting with the month cam disc such that the month cam disc permits or prevents a movement into the second angular position depending on its angular position.

11. The device according to claim 1, comprising a month cam disc coupled onto the month wheel or being formed by the month wheel, wherein the month cam disc codes a month length and permits or prevents a movement into the second position depending on its angular position.

12. The device according to claim 1, wherein the rotation axis of the driving device adopts a third position relative to the date wheel, in which third position the driving device does not interact with the date wheel; and in which the date can be set via crown which is attached at the outside on a casing of the watch, wherein the driving device can be brought into the third position by way of actuating the crown.

13. A watch, comprising the device according to claim 1.

* * * * *